United States Patent [19]

Sporer

[11] Patent Number: 4,943,816

[45] Date of Patent: Jul. 24, 1990

[54] HIGH QUALITY THERMAL JET PRINTER CONFIGURATION SUITABLE FOR PRODUCING COLOR IMAGES

[75] Inventor: Alfred H. Sporer, San Jose, Calif.

[73] Assignee: International Business Machines Corporation, Armonk, N.Y.

[21] Appl. No.: 366,109

[22] Filed: Jun. 14, 1989

[51] Int. Cl.[5] ..... B41J 2/05; B41J 27/14

[52] U.S. Cl. ..... 346/25; 346/140 R; 427/145

[58] Field of Search ..... 346/25, 75, 140, 1.1, 346/21, 157, 46; 427/145; 118/645, 653, 654

[56] References Cited

U.S. PATENT DOCUMENTS

| | | | |
|---|---|---|---|
| 3,232,190 | 2/1966 | Willmott | 95/1.7 |
| 3,265,522 | 8/1966 | Games | 117/25 |
| 3,444,809 | 5/1969 | Ohkubo et al. | 101/470 |
| 3,731,146 | 5/1973 | Bettiga et al. | 317/3 |
| 3,754,963 | 8/1973 | Chang | 117/17.5 |
| 3,963,338 | 6/1976 | Altman | 353/120 |
| 4,095,233 | 6/1978 | Goffe | 346/1.1 X |
| 4,312,268 | 1/1982 | King | 346/75 X |
| 4,382,262 | 5/1983 | Savit | 346/1.1 |
| 4,683,191 | 7/1987 | Geisler | 430/291 |

OTHER PUBLICATIONS

Gerace et al., Liquid Jet Imaging System, Xerox Disc Journal, vol. 1, No. 3, Mar. 1976, p. 31.

*Primary Examiner*—Joseph W. Hartary
*Attorney, Agent, or Firm*—Otto Schmid, Jr.

[57] ABSTRACT

A printer suitable for color printing which uses an ink jet printhead in which the marking fluid contains no dye so that a latent image of the desired print pattern is produced in the form of moistened spots directly on the print medium. The latent image is then developed by applying some colored powder to the print medium, and the developed image is then fixed to the print medium to produce a visible image of the desired print pattern.

18 Claims, 4 Drawing Sheets

HIGH QUALITY THERMAL JET PRINTER CONFIGURATION SUITABLE FOR PRODUCING COLOR IMAGES

BACKGROUND OF THE INVENTION

1. Field of the Invention

The invention relates generally to a impact printer and, more particularly, to a printer in which a printing fluid is ejected from a nozzle.

2. Description of the Prior Art

Printers of various kinds have been which employ droplets for printing by depositing discrete drops of printing fluid such as ink on a recording such as a paper sheet in a predetermined pattern. Some of these printers have used static pressure to ex the ink through an orifice to produce a stream of droplet and others of these printers, known as ink jet drop-on-demand printers, have been developed which eject a small of ink only upon electrical command.

While printers of the type described experienced significant improvement and development the years, such printers suffer from a number of serious limitations particularly with respect to the tradeoff must be made in formulating suitable printing inks. For example, for short drying time a rapidly drying ink would be desirable, but such an ink dries in the nozzle during dormancy time of the printhead which creates a maintenance problem. Should one try to solve the problem by a print sheet penetrant in the ink, then drying maintenance are acceptable, but the ink may spread in print sheet which lowers print quality.

To maintain high print quality and printhead maintenance, the present state of the art high water content inks containing highly water dyes with low levels of ionic salt impurities which are likely to precipitate from the ink on evaporation of water at the nozzle surface. These dyes generally suffer the disadvantage of poor waterfastness and poor archivality.

Additional concerns regarding ink jet printing are printhead lifetime and reliability. Often printhead lifetime is limited by corrosion resulting from ink components required for a good ink formulation. It has been shown in the art that the dye and the ions present in inks are the major culprit causing printhead failures. If the pH is too high or too low these can readily corrode the electrical contacts through or pinholes in the protective layers. Other common for example, chloride ions, even at low levels can cause corrosive failure over long periods of time.

While many of the cited problems have solved for low usage, low throughput serial printers, 50 to several hundred nozzles per printhead, the printhead lifetime reliability problem becomes formidable when contemplating page-wide printing with ink printing technology. In this case one would of as many as 2,400 nozzles or more. Furthermore, to print a color image would require three color arrays and in some cases one black nozzle array. It is clear therefore, that the reliability problem for color page printing is formidable by simple extensions of existing technology.

It is therefore the object of this invention to disclose an ink jet process that replaces the ink with a colorless marking fluid which will create a latent image developable in a subsequent step. If the dye is omitted and a simple fluid used then the maintenance of the printhead and its lifetime can be significantly enhanced.

Other prior art imaging processes are known in which a latent image is produced by some colorless marking fluid, and the latent image is developed in a subsequent operation. For example, U.S. Pat. No. 3,265,522 discloses a copying process in which an original to be copied is heated while in contact with an oil so that the oil evaporates from the surface of the original and condenses on a copy surface to form a latent image which is then developed with a colored powder.

U.S. Pat. No. 3,444,809, et al, discloses a reproduction process in which an oil latent image is formed on a support. The oil latent image is developed with a thermoadhesive powder. The thermoadhesive powder image is then heated and transferred to an image receiving sheet where it is developed by a developing powder.

U.S. Pat. No. 4,683,191 discloses an imaging system in which a latent liquid image is formed on a substrate and contacted with toner powder which can exist as a supercooled liquid. The toner powder is then allowed to solidify.

U.S. Pat. No. 3,963,338 relates to an image projector in which an image sheet has a layer of a dry etchant powder which can be modified by a manually applied writing fluid containing an etchant activator to produce a desired image for projection.

All of the cited references refer to the reproduction of existing images, but none of the cited references suggest the creation of a latent image on a print sheet by an ink jet printhead projecting a dyeless marking fluid and subsequently developing and fixing the image to the print sheet to provide a visual image of the desired pattern defined by the control signals by which the ink jet printhead is selectively actuated.

SUMMARY OF THE INVENTION

It is therefore the principal object of this invention to provide a printer which produces a latent image on a print medium by an ink jet printhead projecting a dyeless marking fluid and subsequently developing and fixing the image to the recording medium.

In accordance with the invention, a printing apparatus suitable for producing color images comprises an ink jet printhead for selectively producing drops of a dyeless marking fluid and means for controlling the ink jet printhead to produce a latent image in the form of moistened spots on a print medium. The latent image is then developed to produce a visible image on the print medium. The developed image is then fixed to the print medium to produce a permanent image of the desired print pattern on the print medium. The printing apparatus is suitable for page printing and for color printing.

The foregoing and other objects, features and advantages of the invention will be apparent from the following more particular description of a preferred embodiment of the invention as illustrated in the accompanying drawings.

DETAILED DESCRIPTION OF THE PREFERRED EMBODIMENTS

The printer, according to the present invention, uses an ink jet printhead in which the marking fluid contains no dye or other additives so that a latent image of the desired print pattern is produced in the form of moistened spots of fluid directly on the print medium. The latent image is then developed by applying some colored powder to the print medium to produce a developed image, and the developed image is then fixed to the print medium to produce the desired pattern. This printing apparatus has the advantage that it is suitable for color page printing, and without the lifetime or maintenance problems, previously associated with a printhead comprising an extended nozzle array.

Figure 1:
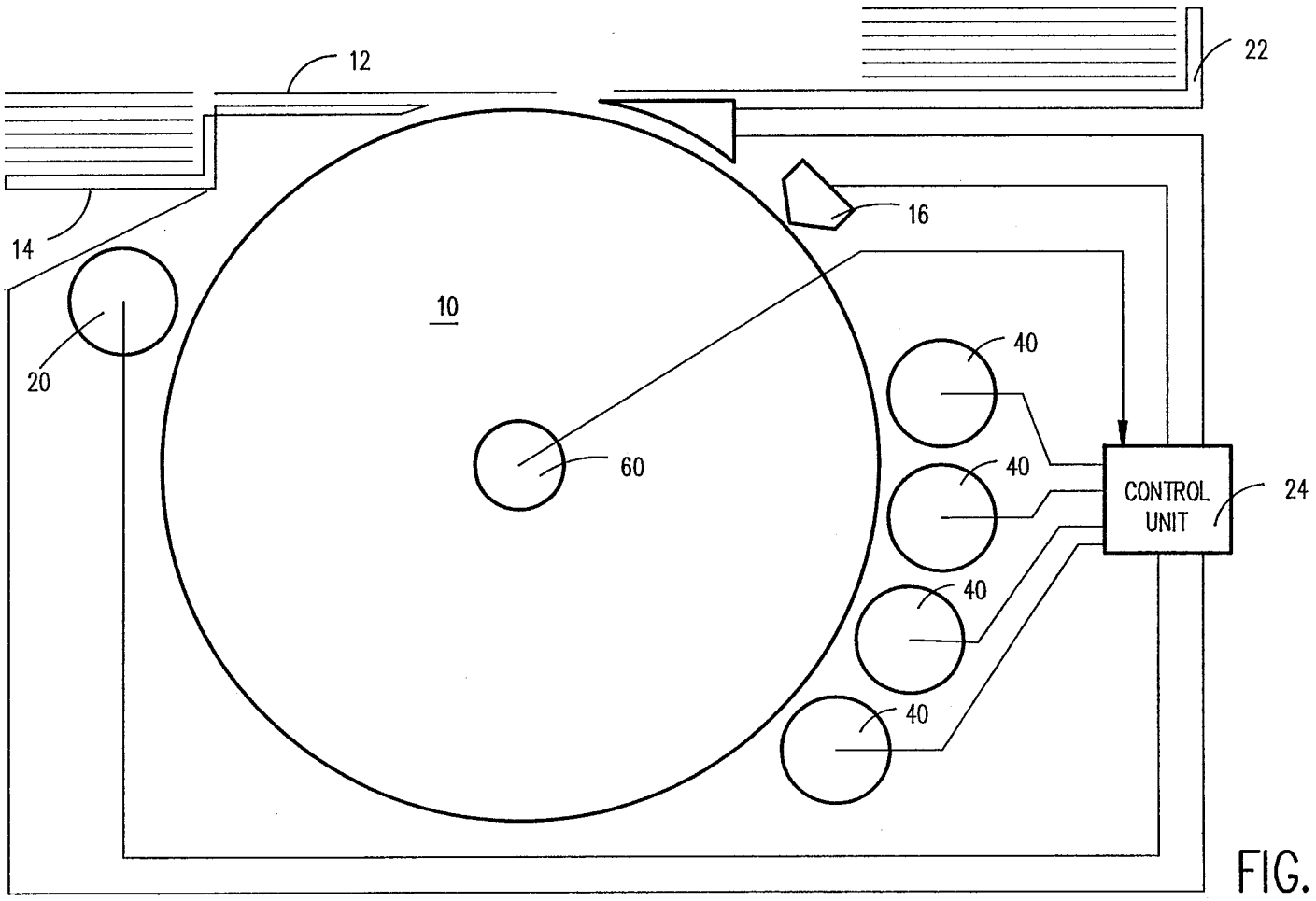
FIG. 1 is a side view of the printer according to the present invention.

Referring to the specific embodiment shown in FIG. 1, the printer, according to the present invention, comprises a rotatable print drum 10 having a plurality of stations around the periphery of the drum 10 suitable for producing a desired image on a print sheet 12 such as a sheet fed from sheet feeding means 14. The print sheet 12 such as paper, for example, is fed past a printhead 16 where a latent image of the desired pattern is produced as will be described in detail below. The print sheet 12 is then transported to the developer station 18 where the latent image is developed into a visible image which is fixed on print sheet 12 at fixing station 20 to make permanent the desired image on print sheet 12. Print sheet 12 may then be transported to a sheet output station 22 or maintained on print drum 10 for a further cycle of image production on print sheet 12. This printing apparatus has the advantage that color images can be produced by combining successive cycles of image production until an image of the desired pattern and color is produced.

Control of the printer in producing the various cycles of image production is provided by a control unit 24 which preferably includes a microprocessor. Control unit 24 stores the data corresponding to the image pattern to be printed, generates signals to control the various components of the imaging apparatus, and executes control over the imaging apparatus to effect printing of the image pattern.

Figure 2:
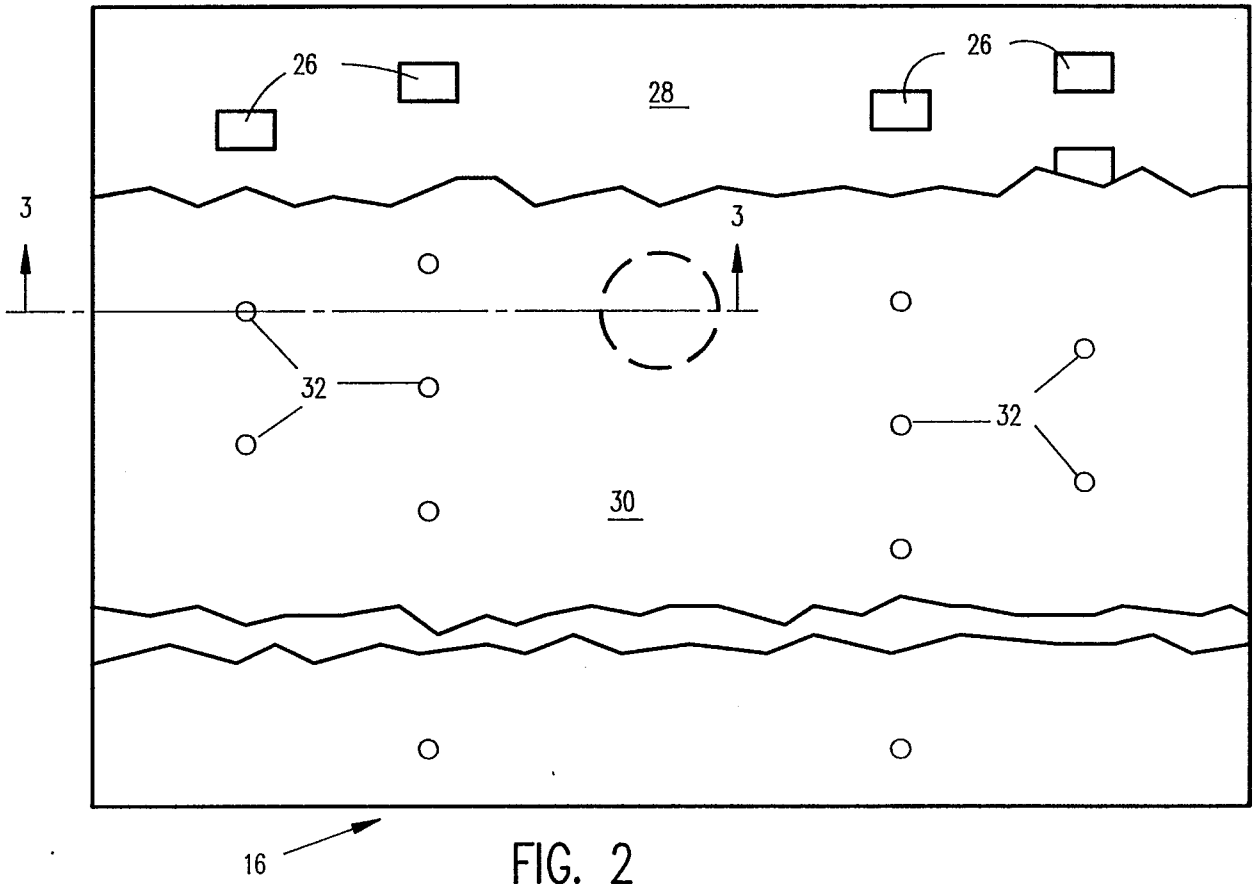
FIG. 2 is a front view of the printhead with some parts cut away according to a specific embodiment of the invention.
Figure 3:
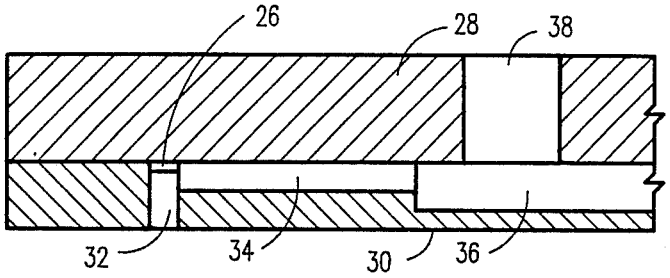
FIG. 3 is view taken along lines 3—3 of FIG. 2.
Figure 5:
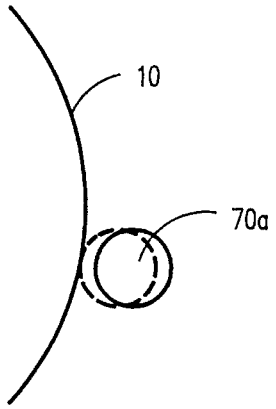
FIG. 5 is a side view showing a specific embodiment of one developer according to the present invention.

According to a specific embodiment of the invention, printhead 16 comprises a thermal ink jet drop-on-demand printing apparatus. With reference to FIGS. 2 and 3, printhead 16 comprises an array of heating elements 26 on one surface of an electrically insulating substrate 28. A nozzle plate 30 is mounted adjacent to the substrate member 28 with a nozzle 32 adjacent to each of the heating elements 26. The nozzle plate 30 also includes a channel 34 which leads from an ink manifold 36 to each of the nozzles 32. Ink manifold 36 is positioned to receive ink from ink supply openings 38. In operation, heating elements 26 are selectively energized to form a "bubble" in the adjacent ink. The rapid growth of the bubble causes an ink drop to be ejected from the associated nozzle 32. Printing is accomplished by energizing the heating element 26 each time a drop is required at that nozzle position to produce the desired print image.

In the specific embodiment shown in FIGS. 2 and 3, the resistive heater elements 26 are arranged in four spaced rows, and the heater elements 26 in one row are preferably staggered with respect to the heater elements in the other rows. Any desired print placement can be achieved by selecting the number of rows and the offset between corresponding heater elements in adjacent rows.

Figure 4:
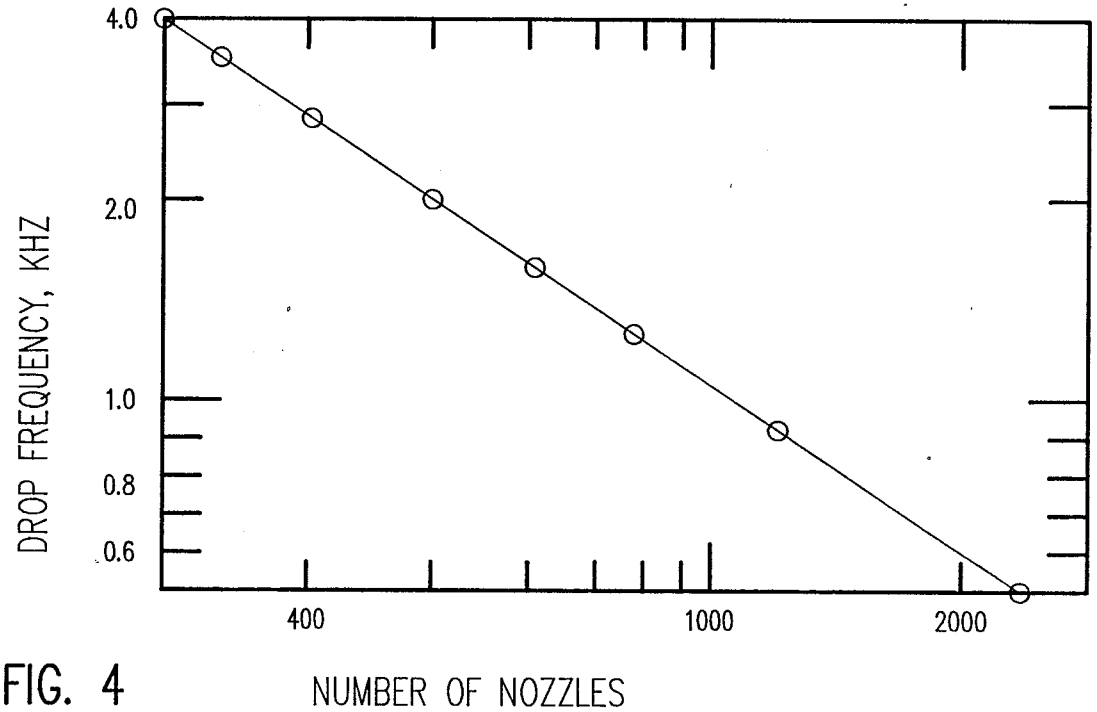
FIG. 4 is a plot of the required drop frequency vs number of nozzles required for a printer according to the present invention with a burst speed throughput of 10 pages per minute.

FIG. 4 is a plot of required drop frequency vs nozzle number required for a printer with a burst speed throughput of 10 pages per minute. This plot is based on a resolution of about 300 dots per inch since this is a typically used resolution in desktop publishing applications, for example. The highest drop frequency shown in this plot, 4.0 kHz, only requires a 300 nozzle array. Thus an array of printheads with 300 nozzles would be capable of generating a burst rate throughput of 10 pages per minute of black or monochrome color and 2.5 pages per minute of full color printing. These design points are well within the present day capabilities of drop-on-demand and other ink jet printheads. Since ink jet drop rates as high as 10 kHz have been demonstrated, throughputs of 25–200 pages per minute (black-/monochrome) can be achieved.

Energizing a selected heating element 26 causes a drop of ink to be ejected from the corresponding nozzle. By the appropriate timing of the energization of the rows of heating elements 26, a line of drops can be printed which extends across the entire print sheet 12. This mode of operation can be achieved by a single printhead which extends across the width of the print sheet 12, or, alternatively, by the use of a plurality of modular printheads each of which extends partially across the print sheet and mounting the plurality of the modular units aligned to extend across the print sheet. One suitable printhead arrangement is that described in greater detail and claimed in commonly assigned U.S. Pat. No. 4,791,440.

The marking fluid or ink that is ejected in the desired image pattern by printhead 16 comprises a dyeless marking fluid so that no visible image is produced by the marking fluid on print sheet 12. The latent image is then developed by applying a colored powder at the developer station 18 to produce a developed image.

The 'latent' image of dyeless fluid deposited directly on the output paper by the ink jet printhead can be used to develop a visible image because of general surface tension forces which increases the adhesion of a dry powder to the wetted drop area on the substrate. Because of the short range of the adhesive forces of the liquid droplet only that portion of the droplet that has NOT penetrated or feathered into the paper is available for attracting toner powder. Consider, then, a roller coated with a uniform layer of powder brought into proximity with the paper containing the 'latent' droplet image. Wherever there is a 'latent' droplet 'on' (but not 'in') the paper, powder adheres. If the powder is a dye soluble in the fluid it dissolves in the 'latent' image. If the powder is a thermoplastic toner particle, such as used in electrophotography, then it adheres to the droplet. The toner is then subsequently fixed to the paper at the fixing station.

One advantage of the disclosed process is that it produces print with HIGH print quality on ANY office bond paper and without the usual tradeoff in ink jet printing between drying time and print quality. Another advantage of using a dyeless fluid in the printhead is that color printing can be achieved with only ONE nozzle array rather than FOUR arrays (ONE for each of the three primary colors plus ONE for black). By this process the throughput for an all-BLACK image is not compromised as in the present state of the art (for the same number of nozzles and the same drop rate) and only for COLOR images does one have the tradeoff of a factor of four reduction in throughput but with a corresponding fourfold reduction in printhead cost and an increase in printhead lifetime and reliability.

The marking fluid is chosen as one having a high surface energy, which is relatively non-wetting to conventional bond paper, and which is compatible with the jetting requirements of the ink jet printhead. The marking fluid specifically should not have any salts or soluble solid material since these materials are known to cause potential maintenance problems in ink jet printers. The preferred components of the marking fluid are miscible with water and have a boiling point higher than water so that the marking fluid is non-volatile at ambient conditions.

While a number of dyeless fluids may be used to practice the present invention, they must meet a few criteria. They must not be corrosive or in any way reactive with any component of the printhead and ink system and they must not contain impurities which are similarly detrimental. Their fluid viscosity must be adjustable for the given ink jet configuration for optimum jettability. Generally, the viscosity should be in the range of a few to as much as 25 centipoise (Cp). In addition, the fluid should be thermally and environmentally stable over long periods of time. Finally, the dyeless fluid should NOT wet and penetrate into the paper in the time between its deposition and development at the developer station because it is the drop 'on' and not 'in' the paper to which the developer powder adheres. Accordingly, the surface tension of the fluid should be above 40 Newtons/Meter$^2$(dynes/cm$^2$)

The dyeless fluids that meet the above criteria are mixtures of water with glycol ethers and polyhydric alcohols. Glycol ethers and polyhydric alcohols are aliphatic compounds containing more than one hydroxylic group. Typical examples are ethylene glycol, glycerol and the glycol ethers. The advantage of these materials are that they are nonionic, are thermally stable, and are completely miscible with water. Suitable materials include glycol ethers and polyhydric alcohols, for example. The preferred marking fluid comprises 50% by weight of water, and the balance ethylene glycol.

The latent image produced on print sheet 12 by printhead 16 is transported, by movement of the print drum 10, to the developer station 18 where a visible image is produced on print sheet 12. The developer station comprises any suitable apparatus for applying a colored powder to produce a visible image corresponding to the marking fluid image produced on print sheet 12 as print sheet 12 was transported past printhead 16. The developer station may comprise impression developer apparatus, cascade developer apparatus, or so called jump developer apparatus.

Figure 6:
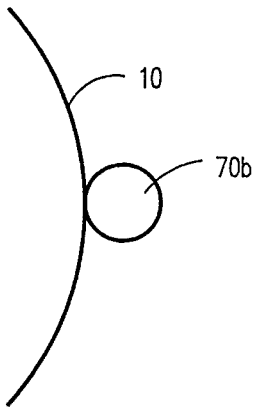
FIG. 6 is a view of an alternate embodiment of the developer according to the present invention.

In the specific embodiment shown in FIG. 1, developer station 18 comprises a plurality of separate developer apparatus 40. In the preferred embodiment each of the developer apparatus 40 comprises an impression developer apparatus. Each of the developer apparatus 40 preferably utilizes a different color powder such as a toner, for example. As shown in FIG. 6, a selected one of the developer apparatus **40*a* is moved from the full line (inactive) position to the dashed line (active) position. Movement of the selected developer apparatus is under control of a signal from control unit 24** to activate a solenoid which is coupled to move the selected developer apparatus to the active position. Impression developer apparatus is described in greater detail and claimed in commonly assigned U.S. Pat. Nos. 3,731,146 and 3,754,963.

An alternate embodiment of the developer apparatus is shown in FIG. 7. A jump developer apparatus **40*b* is provided. Note that jump developer apparatus 40*b* remains in a fixed position adjacent to the print drum. The jump developer apparatus is activated by a signal from control unit 24 which turns ON a voltage source connected to the developer apparatus and the field produced by this voltage causes the toner powder to "jump" across the small gap between the grounded print drum and the developer apparatus to produce a visible image of the latent image produced by printhead 16**. Jump developer apparatus is described in greater detail in U.S. Pat. No. 3,232,190.

Each of the developer apparatus 40 may have a different color powder so that full color images can be produced by producing a selected image for each color of black, magenta, cyan and yellow. One color image is produced for each cycle around the print drum which includes fusing the colored powder to the print sheet 12 at the fusing station 20. The fusing station may comprise a hot roll fuser, for example. The print sheet 12 is then transported for further cycles around print drum 10 until all parts of the image have been produced by the developer apparatus 40.

The operation of the printer is under control of the control unit 24. Data representing characters or images to be printed can be communicated to the printer from an associated data processing unit, a scanner, facsimile transmission, or other suitable data source.

Control unit 24 produces signals to control all of the stations of the imaging apparatus, and synchronism with movement of the print sheet as it is transported by print drum 10 is provided by an emitter 60 which is mounted on the same shaft as print drum 10. By sensing the signals from emitter 10 relative to a reference or home position, control unit 24 can synchronize signals to the various stations with movement of the print sheet along with the print drum. Once the desired image is produced on the sheet 12, a signal from control unit 24 actuates picker mechanism 62 to divert the print sheet from the print drum 10 to the sheet path to sheet output station 22.

EXAMPLE 1

A commercially available thermal ink jet drop-on-demand printer having a printhead similar to the printhead shown in FIG. 1 was used with a dyeless fluid placed in a previously cleaned ink cartridge. The dyeless fluid was a solution of 25% by weight of diethylene glycol and water. The 25% diethylene glycol dyeless fluid was tested in this printer and was found to cause no kogation and no etching of the heater arrays. The lifetime of the thermal ink jet drop-on-demand printhead with such a simple fluid is estimated to be many billions of cycles. The dyeless fluid cartridge was placed in the printer and a standard test pattern was printed on conventional fanfold computer printout paper. The test pattern was in the form of a latent image only faintly discernible under specularly reflected light. An applicator was impregnated with nigrosine dye powder and rolled on the regions on the paper of the latent image. The latent image was now clearly discernible to the eye.

EXAMPLE 2

The printer apparatus described in Example 1 was used, but a cleaned cartridge was filled with a solution of 50% by weight of ethylene glycol and water. The dyeless fluid cartridge was placed in the printer and a standard test pattern was printed on conventional fan-fold computer printout paper. The test pattern was in the form of a latent image only faintly discernible under specularly reflected light. An applicator was impregnated with Food Black 2 dye powder and rolled on the regions on the paper of the latent image. The latent image was now clearly discernible to the eye. The Food Black 2 image was fixed by passing the paper, image side down, over the vapors condensing above a 50% isopropyl alcohol/water solution.

EXAMPLE 3

A thermal ink jet drop-on-demand printer was used in which a cleaned cartridge was filled with a 50% by weight diethylene glycol in water solution. This 50% diethylene glycol dyeless fluid has been tested in this printer and found to cause no kogation and no etching of the heater arrays. The lifetime of thermal jet heads with such a simple fluid is estimated to be many billions of cycles. The dyeless fluid cartridge was placed in the printer and the printer was activated to print a standard test pattern. Droplets of this colorless fluid formed a 'latent' image (only visible by specular reflection from the paper). The latent image was developed by cascading a conventional xerographic toner (Canon toner used in Canon PC-10 copiers) over the paper.

The above experiment was repeated with the following toners:

Ricoh toner (for the Oki laser printer)
Xerox developer (1065)
IBM Series III toner The imagewise adhering powdered dye or pigment was then fixed to the paper by putting it through a conventional copier fusing station.

EXAMPLE 4

Contact of a developer roll to the paper not only transfers toner powder to the 'latent' droplet image but also to a lesser extent to the paper where it creates unwanted background. To reduce general background, bias voltages were applied to the roller during development to see whether it would reduce image background. It was found that both image and background density would be raised or lowered by application of a bias voltage. The best results were obtained when the voltage (+300–500 V) was applied during development followed by a reversal of the voltage for cleanup. In the first step toner deposited everywhere and in the second step it was removed primarily in the background areas. An AC developer system therefore seemed likely to work best. The developer roll was therefore connected to an AC power supply generator capable of generating up to 100 V with a frequency up to a few KHz. Low background development was obtained with a 100 V bias and between 0.1 and 1 msec pulse width over a range of frequencies. At the low frequency up to 200 Hz developer banding was observed at low development roller speeds (about 10 in/sec) but these disappeared at the higher development rate of about 20 in/sec.

EXAMPLE 5

To reduce image background Example 3 was repeated with toner mixed with a silica aerogel to neutralize any triboelectric charges. A noticeable reduction of background was observed with essentially no change in image density.

While the invention has been particularly shown and described with reference to a preferred embodiment thereof, it will be understood by those skilled in the art that various other changes in the form and details may be made therein without departing from the spirit and scope of the invention.

Having thus described our invention, what we claim as new, and desire to secure by Letters Patent is:

1. A printer suitable for producing color images comprising:

an ink jet printhead for selectively producing drops of a dyeless marking fluid consisting essentially of a mixture of water and a glycol ether;

an image receiving substrate;

means for controlling said ink jet printhead to selectively eject said dyeless marking fluid to produce a fluid image of a desired pattern upon said substrate;

a plurality of roll developing means for developing said fluid image on said substrate while still moist to produce a visible image on said substrate; and means for fixing said developed image to said substrate to produce a permanent image of the desired pattern on said substrate.

2. The printer of claim 1 wherein said ink jet printhead comprises a drop-on-demand ink jet printhead.

3. The printer of claim 2 wherein said drop-on-demand ink jet printhead comprises a thermal drop-on-demand ink jet printhead.

4. The printer of claim 1 wherein said roll developing means for developing said fluid image comprises an impression developer apparatus.

5. The printer of claim 4 wherein said plurality of roll developing means comprises one roll developing means to produce black and one roll developing means to produce each of the three primary colors.

6. The printer of claim 1 wherein said roll developing means for developing said fluid image comprises a jump developer apparatus.

7. The printer of claim 6 wherein said plurality of roll developing means comprises one roll developing means to produce black and one roll developing means to produce each of the three primary colors.

8. The printer of claim 1 wherein said dyeless marking fluid consists essentially of a mixture of water and a material selected from the group consisting of ethylene glycol, diethylene glycol and polyethylene glycols.

9. The printer of claim 8 wherein said dyeless marking fluid consists essentially of a mixture of fifty percent by weight of water and the balance ethylene glycol.

10. A printer suitable for producing color images comprising:

an ink jet printhead for selectively producing drops of a dyeless marking fluid consisting essentially of a mixture of water and a polyhydric alcohol;

an image receiving substrate;

means for controlling said ink jet printhead to selectively eject said dyeless marking fluid to produce a fluid image of a desired pattern on said substrate;

a plurality of roll developing means for developing said fluid image on said substrate while still moist to produce a visible image on said substrate; and means for fixing said developed image to said substrate to produce a permanent image of the desired pattern an said substrate.

11. The printer of claim 10 wherein said dyeless marking fluid consists essentially of a mixture of water and a material selected from the group consisting of glycerol, ethylene, diethylene and propylene glycols.

12. The printer of claim 11 wherein said dyeless fluid consists essentially of a mixture of fifty percent by weight of water and the balance a water miscible high boiling polyhydric alcohol, glycol or ether.

13. The printer of claim 10 wherein said ink jet printhead comprises a drop-on-demand ink jet printhead.

14. The printer of claim 13 wherein said drop-on-demand ink jet printhead comprises a thermal drop-on demand ink jet printhead.

15. The printer of claim 10 wherein said roll developing means for developing said fluid image comprises an impression developer apparatus.

16. The printer of claim 15 wherein said plurality of roll developing means comprising one roll developing means to produce black and one roll developing means to produce each of the three primary colors.

17. The printer of claim 10 wherein said roll developing means for developing said fluid image comprises a jump developer apparatus.

18. The printer of claim 17 wherein said plurality of roll developing means comprises one roll developing means to produce black and one roll developing means to produce each of the three primary colors.

* * * * *

UNITED STATES PATENT AND TRADEMARK OFFICE

CERTIFICATE OF CORRECTION

PATENT NO. : 4,943,816

DATED : July 24, 1990

INVENTOR(S) : A. H. Sporer

It is certified that error appears in the above-identified patent and that said Letters Patent is hereby corrected as shown below:

In column 1, line 9, after "a", insert --non---
In column 1, line 17, delete "ex", insert --expel--
In column 1, line 23, after "development", insert --over--
In column 1, line 24, after "limitations", insert --,--
In column 1, line 25, delete "tradeoff", insert --tradeoffs--
In column 1, line 31, after "drying", insert --time and--
In column 1, line 32, after "in", insert --the--
In column 1, line 34, after "and", insert --low--
In column 1, line 36, after "water", insert --soluble--
In column 1, line 46, after "printhead", insert --lifetime--
In column 1, line 47, after "these", insert --additives--
In column 1, line 48, after "through", insert --defects--
In column 1, line 49, after "common", insert --ions,--
In column 1, line 52, after "have", insert --been--
In column 1, line 53, after "printers,", insert --with--
In column 1, line 56, after "ink", insert --jet--
In column 1, line 57, after "would", insert --require arrays--
In column 1, line 59, after "color", insert --nozzle--
In column 7, line 63, delete "100 V", insert --+ 100 V--
In column 9, line 11, after "dyeless", insert --marking--

Signed and Sealed this

Eleventh Day of February, 1992

*Attest:*

HARRY F. MANBECK, JR.

*Attesting Officer*

*Commissioner of Patents and Trademarks*